United States Patent [19]

Sung et al.

[11] Patent Number: 4,981,604

[45] Date of Patent: Jan. 1, 1991

[54] OXIDATION AND CORROSION RESISTANT DIESEL ENGINE LUBRICANT

[75] Inventors: Rodney L. Sung, Fishkill; Benjamin H. Zoleski, Beacon; Ronald L. O'Rourke, Hyde Park, all of N.Y.

[73] Assignee: Texaco Inc., White Plains, N.Y.

[21] Appl. No.: 302,494

[22] Filed: Jan. 27, 1989

[51] Int. Cl.[5] ..... C10M 133/46

[52] U.S. Cl. ..... 252/51.5 A

[58] Field of Search ..... 252/51.5 A

[56] References Cited

U.S. PATENT DOCUMENTS

| | | | |
|---|---|---|---|
| 3,806,456 | 4/1974 | Vogel | 252/51.5 A |
| 4,048,082 | 9/1977 | Nnadi | 252/51.5 A |
| 4,064,059 | 12/1977 | Nebzydoski | 252/51.5 A |
| 4,153,564 | 5/1979 | Chibnik | 252/51.5 A |

FOREIGN PATENT DOCUMENTS

| | | | |
|---|---|---|---|
| 50-13751 | 5/1975 | Japan | 252/51.5 A |
| 50-13752 | 5/1975 | Japan | 252/51.5 A |

*Primary Examiner*—Olik Chaudhuri
*Assistant Examiner*—Jerry D. Johnson
*Attorney, Agent, or Firm*—Robert A. Kulason; James J. O'Loughlin; Vincent A. Mallare

[57] ABSTRACT

An oxidation and corrosion resistant diesel engine lubricant composition, particularly useful in marine and railway diesel engines, comprises a major amount of a base hydrocarbon lubricating oil and from 0.1–5.0 weight percent of a reaction product additive which is the reaction product of a dibasic acid anhydride, a polyoxyalkylene diamine, and a heterocyclic azole.

15 Claims, No Drawings

OXIDATION AND CORROSION RESISTANT DIESEL ENGINE LUBRICANT

BACKGROUND OF THE INVENTION

1. Field of the Invention

This invention relates to a diesel engine crankcase lubricating composition which exhibits improved resistance to corrosion and oxidation. More particularly, this invention relates to a novel corrosion and oxidation resistant diesel engine crankcase lubricating composition comprising a major amount of a hydrocarbon lubricating oil and a minor amount of the reaction product of a dibasic acid anhydride reactant, a polyoxyalkylene diamine reactant, and a heterocyclic azole reactant. The instant invention is particularly useful as a lubricant in large diesel engines such as marine and railway diesel engines.

2. Information Disclosure Statement

U.S. Pat. No. 4,865,622 discloses an ORI-inhibited and deposit-resistant motor fuel composition comprising an additive composition which is the reaction product of a dibasic acid anhydride, a polyoxyalkylene diamine, and a heterocyclic azole.

Co-assigned U.S. Pat. No. 4,758,363 (Sung et al.) discloses an oxidation and corrosion-resistant diesel engine lubricant composition comprising a major amount of a hydrocarbon lubricating oil and a minor amount of the reaction product prepared by first reacting a hydroxybenzoic acid with a polyoxyalkylene polyol to produce an ester, and thereafter reacting the esterification product with an aldehyde or ketone and a substituted or unsubstituted heterocyclic azole to form the final reaction product.

Co-assigned U.S. Pat. No. 4,705,642 (Sung et al.) discloses a haze, oxidation, and corrosion-resistant diesel engine lubricant composition which comprises a major amount of a hydrocarbon lubricating oil and a minor amount of the reaction product of an anhydride compound, a hydrocarbon-substituted mono primary amine or ether amine, and a nitrogen-containing heterocyclic azole or polyalkylene polyamine compound.

Co-assigned U.S. Pat. No. 4,464,276 (Sung et al.) describes the preparation of novel polyoxyalkylene polyamine-triazole complexes and their use in diesel lubricant compositions as antioxidants and corrosion-inhibitors.

Co-assigned U.S. Pat. No. 4,285,823 (Sung et al.) discloses a diesel engine lubricant composition comprising a corrosion inhibitor which is the reaction product of an N-alkyl-1,3-propane diamine, formaldehyde, and a 5-aminotetrazole.

SUMMARY OF THE INVENTION

The instant invention relates to a diesel engine crankcase lubricant composition which exhibits improved corrosion and oxidation resistance as compared with conventional diesel engine lubricant formulations. The lubricant composition of the instant invention comprises a major proportion of a hydrocarbon lubricating oil and from about 0.1 to 5.0 weight percent (based on the lubricating oil) of the reaction product obtained by reacting, at a temperature range of 50° C.–200° C.:

(a) 0.5–2.5 moles of a dibasic acid anhydride;

(b) 0.5–1.5 moles of a polyoxyalkylene diamine of the formula $$NH_2-(R_1)_q-[OCH(CH_2CH_3)CH_2]_a-[OCH(CH_3)CH_2]_b-[OCH_2CH_2]_c-[OCH_2CH(CH_3)]_d-[OCH_2CH(CH_2CH_3)]_e-(R_2)_r-NH_2$$

where $R_1$ and $R_2$ are $C_1$–$C_{12}$ alkylene groups, q and r are integers having a value of 0 or 1, c has a value from 2–150, b+d has a value from 2–150, and a+e has a value from 0–12; and (c) 0.5–1.5 moles of a heterocyclic azole.

This invention is also directed to a method of preparing the abovedescribed diesel engine lubricating oil, and to a method of inhibiting the oxidation of a diesel engine lubricating oil composition.

DESCRIPTION OF THE PREFERRED EMBODIMENTS

As is well known to those skilled in the art, lubricating oils must be characterized by resistance to oxidation and corrosion inhibition. Since the oils used as lubricants in the crankcases of large diesel engines, such as marine and railway diesel engines, are subject to unique conditions of operation, special attention must be directed to the potential problems which are to be encountered.

In addition, the advent of new, more fuel efficient railway diesel engines has put a greater demand on the oxidation resistance of railway diesel lubricants. Oxidized lubricants may lead to increased corrosive attack of engine metal surfaces; consequently, lubricants employed in newer railway diesel engines must be changed more frequently to prevent such corrosive attack.

It is an object of this invention to provide a novel diesel engine lubricant composition. It is another object of this invention to provide a novel lubricant composition, suitable for use in large marine and railway diesel engines, characterized by its resistance to oxidation and corrosion. It is yet another object of this invention to provide a method of preparing such a diesel engine lubricant composition, as well as a method of inhibiting the oxidation of a diesel engine lubricant composition.

It is a feature of this invention that a diesel engine lubricant comprising a major amount of a hydrocarbon lubricating oil and a minor amount of the reaction product of a dibasic acid anhydride reactant, a polyoxyalkylene diamine reactant, and a heterocyclic azole reactant is characterized by its resistance to oxidation and corrosion. It is another feature of this invention that such a diesel engine lubricant composition is particularly suitable for use in large marine and railway diesel engines.

It is an advantage of this invention that the corrosion of diesel engine metal surfaces is reduced by employing this invention as a lubricant. It is another advantage of this invention that it may be changed less frequently than other conventional diesel engine lubricants.

The corrosion and oxidation resistant diesel engine lubricating oil of the instant invention comprises a major amount of a base hydrocarbon lubricating oil and from 0.1 to 5.0 weight percent, preferably 0.5 to 2.0 weight percent of a corrosion and oxidation-inhibiting additive which is the reaction product of a dibasic acid anhydride reactant, a polyoxyalkylene diamine reactant, and a heterocyclic azole reactant.

The diesel lubricant compositions of the instant invention include lubricating oils which are employed in large diesel engines, particularly in the crankcases of large diesel engines such as are found in marine service, and in large railway diesel engines. The base hydrocarbon oil which may be employed to prepare the lubricating oil composition of the invention includes naphthenic base, paraffinic base and mixed base mineral oils, lubricating oil derived from coal products and synthetic oils, e.g. alkylene polymers such as polypropylene and polyisobutylene of a molecular weight of between about 250 and 2500. In the case of marine diesel engine lubricants, the preferred lubricant is typically a hydrocarbon lubricating oil having a Total Base Number (TBN) of 3–8, say 6 made up for example by blending a paraffinic Solvent Neutral Oil (SNO-20) having a VI of ca 92 and a viscosity of 47–53 CSt at 40° C. and 6.65–7.15 at 100° C. with a paraffinic Solvent Neutral Oil (SNO-50) having a VI of ca 93 and a viscosity of 158–180 CSt at 40° C. and 15.3–16.4 at 100° C. In the case of railway diesel engine lubricants, the preferred lubricant is typically a mixture of a paraffinic mineral oil of a viscosity of 5.5–10.0, say 8.5 CSt at 100° C., a paraffinic mineral oil of a viscosity of 8.0–15.0, say 14.5 CSt at 100° C., and a naphthenic pale oil of a viscosity of 8.0–15.0, say 14.2 CSt at 100° C.

Typically, the lubricant composition of the instant invention may contain minor amounts of additional additives. Table I sets forth illustrative additives which may be employed in admixture with the instant invention when it is used as a marine diesel engine lubricant.

TABLE I

| Additive Function | Broad Range (wt. %) | Illustrative Additive |
|---|---|---|
| Anti-wear Agent | 0.1–1 | Zinc dialkyl dithiophosphate |
| Oxidation Inhibitor | 0.1–1 | alkylated diphenyl amine |
| Demulsifying Agents | 50–200 ppm | dimethyl polysiloxane (a silicone) |
| Detergent | 1–5 | Overbased sulfurized calcium alkylphenolate |
| Anti-Rust Agent | 0.1–5 | Ethoxylated nonyl phenol |

When the lubricant composition of the instant invention is used as a railway diesel engine lubricant, additional additives or additive packages may also be employed. An illustrative example of an additive concentrate package (commercially available from Chevron Chemical Company as ORONITE OLOA 2939) which may be employed in admixture with the lubricant composition of the instant invention is set forth in Table II.

TABLE II

| Additive | Typical Concentration (wt. %)* |
|---|---|
| Overbased mixed calcium petroleum sulfonate/phenolate | 45 |
| Polyisobutenyl succinimide/amide | 10 |
| Polyisobutylene | 1.5 |
| Paraffinic Mineral Oil | 43 |
| Chloroparaffin | 0.5 |

*Wt. % concentration based on total weight of additive concentrate package.

The ORI-inhibited and deposit-resistant motor fuel composition of the instant invention comprises a reaction product additive which is obtained by reacting a dibasic acid anhydride, a polyoxyalkylene diamine, and a heterocyclic azole. The dibasic acid anhydride reactant used to prepare the reaction product is preferably selected from the group consisting of maleic anhydride, alpha-methyl maleic anhydride, alpha-ethyl maleic anhydride, and alpha, beta-dimethyl maleic anhydride. The most preferred dibasic acid anhydride for use is maleic anhydride.

The polyoxyalkylene diamine reactant used to prepare the reaction product is a diamine of the formula $$NH_2-(R_2)_q-[OCH(CH_2CH_3)CH_2]_a-[OCH(CH_3)CH_2]_b-[OCH_2CH_2]_c-[OCH_2CH(CH_3)]_d-[OCH_2CH(CH_2CH_3)]_e-(R_3)_r-NH_2$$

where $R_2$ and $R_3$ are $C_1$–$C_{12}$ alkylene groups, preferably $C_2$–$C_6$ alkylene group, most preferably a propylene or butylene group, q and r are integers having a value of 0 or 1, preferably with q=1 and r=0, c has a value from about 2–150, preferably 2–50; b+d has a value from about 2–150, preferably 2–50; and a+e has a value from about 0–12, preferably 2–8. In the most preferred embodiment, q=1, r=0, $R_2$ is a butylene group and the polyoxyalkylene diamine reactant is therefore of the formula $$NH_2CH(CH_2CH_3)CH_2-[OCH(CH_2CH_3)CH_2]_a-[OCH(CH_3)CH_2]_b-[OCH_2CH_2]_c-[OCH_2CH(CH_3)]_d-[OCH_2CH(CH_2CH_3)]_e-NH_2$$

where c has a value of from 2–150, preferably 2–50, b+d has a value of from 2–150, preferably 2–50 and a+e has a value of 2–12, preferably 2–8.

In another preferred embodiment, q=1, r=0, $R_2$ is a propylene group, a+e has a value of zero, and the polyoxyalkylene diamine reactant is therefore of the formula $$NH_2-CH(CH_3)CH_2-[OCH(CH_3)CH_2]_b-[OCH_2CH_2]_c-[OCH_2CH(CH_3)]_d-NH_2$$

where c and b+d, respectively, have a value of from 2–150, preferably 2–50. Polyoxyalkylene diamines of the above structure suitable for use include those available from Texaco Chemical Co. under the JEFFAM- INE ED-Series trade name. Specific examples of such compounds are set forth below:

| Trade Name | Approx. Value c | Approx. Value b + d | Approx. Mol. Wt. |
|---|---|---|---|
| ED-600 | 8.5 | 2.5 | 600 |
| ED-900 | 15.5 | 2.5 | 900 |
| ED-2001 | 40.5 | 2.5 | 2000 |
| ED-4000 | 86.0 | 2.5 | 4000 |
| ED-6000 | 131.5 | 2.5 | 6000 |

The heterocyclic azole reactant may be any substituted or unsubstituted heterocyclic azole, but preferably is selected from the group consisting of tolyltriazole (hereinafter referred to as TTZ), benzotriazole (hereinafter referred to as BTZ), aminotriazole (hereinafter referred to as ATZ), aminotetrazole (hereinafter referred to as ATTZ), aminomercaptothiadiazole (hereinafter referred to as AMTZ), and benzomercaptothiazole (hereinafter referred to as BMTZ).

If an aminotriazole reactant is employed, it preferably will be a 3-, 4-, or 5-aminotriazole (hereinafter referred to as 3-ATZ, 4-ATZ, or 5-ATZ, respectively), including those bearing inert substituents, typified by hydrocarbon or alkoxy groups, which do not react in the instant invention. The most preferred aminotriazole reactant is 5-ATZ. If an aminotetrazole reactant is employed, it preferably will be a 4- or 5-aminotetrazole (hereinafter referred to as 4-ATTZ or 5-ATTZ, respectively), again including those bearing inert substituents, typified by hydrocarbon or alkoxy groups which do not react in the instant invention. If an aminomercaptothiadiazole reactant is employed, it preferably will be a 5-aminomercaptothiadiazole. The most preferred hydrocarbyl azole reactant for use in the instant invention is 5-ATZ.

The reaction product additive of the instant invention is prepared by first reacting 0.5–2.5 moles, preferably about 2 moles of the abovedescribed dibasic acid anhydride with 0.5–1.5 moles, preferably about 1 mole of the abovedescribed polyoxyalkylene diamine at a temperature of 30° C.–200° C., preferably 90° C.–150 ° C. to produce a maleamic acid amide. The reaction is preferably carried out in the presence of a solvent. A preferred solvent is one which will distill with water azeotropically. Suitable solvents include hydrocarbons boiling in the gasoline boiling range of about 30° C. to about 200° C. Generally, this will include saturated and unsaturated hydrocarbons having from about 5 to about 10 carbon atoms. Specific suitable hydrocarbon solvents include tetrahydrofuran, hexane, cyclohexane, benzene, toluene, and mixtures thereof. Xylene is the preferred solvent. The solvent can be present in an amount of up to about 90% by weight of the total reaction mixture. Once the reaction has been completed, the maleamic acid amide may be separated from the solvent using conventional means, or left in admixture with some or all of the solvent to facilitate addition of the reaction product to the base lubricant oil.

The maleamic acid amide, either alone or in solution with the abovedescribed solvent, is thereafter reacted with 0.5–1.5 moles, preferably 1 mole of the prescribed heterocyclic azole reactant at a temperature of 50°–100° C., preferably about 80°–100° C. Once the reaction has been completed, the reaction product may be separated from the solvent using conventional means, or left in admixture with some or all of the solvent.

The following examples illustrate the preferred method of preparing the reaction product of the instant invention. It will be understood that the following examples are merely illustrative, and are not meant to limit the invention in any way. In the examples, all parts are parts by weight unless otherwise specified.

EXAMPLE 1

54 parts of maleic anhydride, 3265 parts of xylene, and 3000 parts of a polyoxyalkylene diamine were reacted under nitrogen at a temperature of about 100° C. for approximately 2 hours to produce a maleamic acid amide. The polyoxyalkylene diamine was of the formula

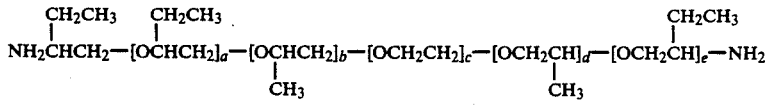

where c had an approximate value of 40.5, b+d had an approximate value of 40.5, and a+e had an approximate value of 2.5. One hundred parts of the amide was stripped under vacuum. Thereafter, 154 parts of a 50% active solution of xylene and the abovedescribed maleamic acid amide and 3 parts of 5-ATZ were reacted at a temperature of about 140° C. until all water had been driven off to produce the final reaction product additive.

EXAMPLE 2

54 parts of maleic anhydride, 3265 parts of xylene, and 3000 parts of a polyoxyalkylene diamine are reacted under nitrogen at a temperature of about 100° C. for approximately 2 hours to produce a maleamic acid amide. The polyoxyalkylene diamine (JEFFAMINE ED-2001) is represented by the formula

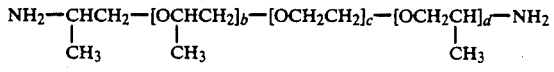

where c has an approximate value of 40.5, and b+d has an approximate value of 2.5. Thereafter, 154 parts of a 50% active solution of xylene and the abovedescribed maleamic acid amide, and 3 parts of 5-ATZ are reacted at a temperature of about 140° C. for approximately 2 hours to produce the final reaction product additive.

The reaction product additive may be added to the base lubricating oil in minor, effective, corrosion inhibiting amounts of about 0.1–5.0 wt. %. Lesser quantities may be employed, but the degree of improvement so obtained may be lessened thereby. Larger amounts may be employed, but no significant additional improvement is thereby attained. Preferably the effective amount is about 0.5–2.0 wt. % based on the lubricating oil. The reaction product compound may be added separately or as a component of an additive package which contains other additives.

Presence of the above-described reaction product compound in a diesel engine lubricating oil such as a railway diesel engine lubricant is found to be particularly advantageous in controlling the degradation characteristics of the lubricant. Degradation of the lubricant often leads to higher acid concentrations within the lubricant, which may in turn lead to corrosive attack of metallic engine surfaces.

The ARCO Railroad Oil Oxidation Test (ARCO Test) was employed to determine the degradation characteristics of lubricant compositions of the instant invention. The ARCO Test is intended for the determination of the oxidation and corrosion characteristics of diesel engine lubricants, is especially useful as a screening test for railway diesel engine lubricants.

The ARCO Test method involves bubbling oxygen at a rate of 5 liters/hr. through 300 gm of test oil held at 300° F. in the presence of three metal coupons, one each made of copper, lead, and steel. At the end of the Test, the total weight change of the coupons is measured, thereby determining the corrosion characteristics of the test oil vis-a-vis the metal coupons. The detailed procedure of the ARCO Test is set forth below.

Three square metal coupons are cut from metal sheets, as follows:

| COUPON | MATERIAL | DIMENSIONS mm × mm × mm | WEIGHT. gm APPROX. |
|---|---|---|---|
| Copper | Electrolytic Copper | 25.4 × 25.4 × 3.12 | 17–18 |
| Steel | Mild Carbon Steel | 25.4 × 25.4 × 3.07 | 15–16 |
| Lead | Chemical Grade Lead | 25.4 × 25.4 × 1.52 | 11–12 |

Two 2.38-mm holes are drilled in each coupon, and the coupons are polished with fine emery cloth and steel wool to obtain a clean, smooth surface, then washed with acetone, dried, and tared. Using clean cotton cord, the coupons are tied together as a hollow prism which stands in an oxidation cell assembly. The oxidation cell includes a test tube, an oxygen inlet tube and a condenser, and is the same cell as used in ASTM Method D-943 "Oxidation Characteristics of Inhibited Steam Turbine Oils" except that no cooling water is used for the condenser.

After placing the coupons into the oxidation cell, the cell is filled with 300 gm of the oil to be tested. The cell is then placed in an oil bath which has been previously adjusted to a temperature of 300±2° F., and heated for 48 hours. Oxygen at a flow rate of 5±0.2 liters/hr. is constantly contacted with the test oil. At the end of 48 hours, the oxygen flow is stopped, and the cell is taken out of the bath and allowed to cool to room temperature.

The coupons are then removed from the cell, washed with a 50/50 blend of toluene and acetone, and allowed to dry. The coupons are thereafter weighed to determine weight changes due to oil oxidation of the metal surfaces. The weight changes of the coupons are reported as the total weight loss of all three coupons. A large weight loss indicates a very corrosive oil which can lead to corrosive attack of engine metal surfaces. In addition, the viscosities of the test oil before and after the Test are measured to determine the effect of oxidation on oil viscosity. The greater the percentage increase in viscosity due to oxidation, the greater the degree of oil degradation which has occurred.

The following examples and ARCO Test results further illustrate the superiority of the instant invention as a diesel engine lubricant, particularly as a railway diesel engine lubricant.

EXAMPLE 3

In this control example, a standard railway diesel engine lubricant was formulated containing the following components:

| Component | wt. % |
|---|---|
| (i) Paraffinic mineral oil of viscosity 8.46 CSt at 100° C. | 19.12 |
| (ii) Paraffinic mineral oil of viscosity 14.5 CSt at 100° C. | 22.48 |
| (iii) Naphthenic pale oil of viscosity 14.2 CSt at 100° C. | 43.76 |
| (iv) ORONITE OLOA 2939 brand additive package* | 14.64 |

*See TABLE II

This formulation is representative of conventional railway diesel engine crankcase lubricants. It was tested via the ARCO Test and found to have a total coupon weight loss of 0.2129 gm and a viscosity increase of 15.1%.

EXAMPLE 4

A lubricant formulation was made up containing 98 wt. % of the base lubricant of Example 3 and 2.0 wt. % of the reaction product of Example 1. This formulation is representative of lubricant formulations of the instant invention. It was tested via the ARCO Test and found to have a total coupon weight loss of 0.0544 gm and a viscosity increase of 7.7%.

As demonstrated by a comparison of the ARCO Test results for Examples 3 and 4, a composition of the instant invention formulated for use as a railway diesel engine lubricant (Example 4) exhibited less degradation after exposure to the test conditions of the ARCO Test than a conventional railway diesel engine lubricant formulation (Example 3). Example 4 showed both lower viscosity increase (hence less oxidation) and lower total coupon weight loss (hence less corrosive attack of metal surfaces) than the conventional lubricant of Example 3; therefore the instant invention as exemplified by Example 4 is superior to a conventional diesel lubricant as exemplified by Example 3 in terms of both oxidation and corrosion resistance.

Although this invention has been illustrated by reference to specific embodiments, it will be apparent to those skilled in the art that various changes and modifications may be made which clearly fall within the scope of this invention. For example, reaction product compositions of the instant invention may also be useful as corrosion inhibitors in other types of compositions such as motor fuels, alcohols, metal working fluids, and the like.

The invention claimed is:

1. A diesel engine lubricating oil composition comprising a major amount of a hydrocarbon lubricating oil and from 0.1–5.0 weight percent of the reaction product obtained by reacting at a temperature range of 50° C.–200° C.:

(a) 0.5–2.5 moles of a dibasic acid anhydride;

(b) 0.5–1.5 moles of a polyoxyalkylene diamine of the formula $$NH_2-(R_1)_q-[OCH\overset{CH_2CH_3}{\overset{|}{C}}H_2]_a-[OCH\underset{CH_3}{\underset{|}{C}}H_2]_b-[OCH_2CH_2]_c-$$

-continued $$-[OCH_2\underset{\underset{CH_3}{|}}{CH}]_d-[OCH_2\overset{\overset{CH_2CH_3}{|}}{CH}]_e-(R_2)_r-NH_2$$

where $R_1$ and $R_2$ are $C_1$–$C_{12}$ alkylene groups, q and r are integers having a value of 0 or 1, c has a value from 2–150, b+d has a value from 2–150, and a+e has a value from 0–12; and (c) 0.5–1.5 moles of a heterocyclic azole.

2. A lubricating oil composition according to claim 1, where said dibasic acid anhydride is maleic anhydride.

3. A lubricating oil composition according to claim 1, where said polyoxyalkylene diamine is of the formula $$NH_2\overset{\overset{CH_2CH_3}{|}}{CH}CH_2-[O\overset{\overset{CH_2CH_3}{|}}{CH}CH_2]_a-[O\underset{\underset{CH_3}{|}}{CH}CH_2]_b-[OCH_2CH_2]_c-$$

$$-[OCH_2\underset{\underset{CH_3}{|}}{CH}]_d-[OCH_2\overset{\overset{CH_2CH_3}{|}}{CH}]_e-NH_2$$

where c has a value from about 2–50, b+d has a value from about 2–50, and a+e has a value from about 2–8.

4. A lubricating oil according to claim 1, where said polyoxyalkylene diamine is of the formula $$NH_2-\underset{\underset{CH_3}{|}}{CH}CH_2-[O\underset{\underset{CH_3}{|}}{CH}CH_2]_b-[OCH_2CH_2]_c-[OCH_2\underset{\underset{CH_3}{|}}{CH}]_d-NH_2$$

where c has a value of 2–50, and b+d has a value of 2–50.

5. A lubricating oil composition according to claim 1, where said heterocyclic azole is an aminotriazole.

6. A lubricating oil composition according to claim 5, where said aminotriazole is selected from the group consisting of 3-aminotriazole 4-aminotriazole and 5-aminotriazole.

7. A lubricating oil composition according to claim 1, where said heterocyclic azole is an aminotetrazole.

8. A lubricating oil composition according to claim 7, where said aminotetrazole is selected from the group consisting of 4-aminotetrazole and 5-aminotetrazole.

9. A lubricating oil composition according to claim 1, where said heterocyclic azole is an aminomercaptothiadiazole.

10. A lubricating oil composition according to claim 9, where said aminomercaptothiadiazole is a 5-aminomercaptothiadiazole.

11. A lubricating oil composition according to claim 1, where said heterocyclic azole is a benzomercaptothiazole.

12. A lubricating oil composition according to claim 1, where said heterocyclic azole is benzotriazole.

13. A lubricating oil composition according to claim 1, where said heterocyclic azole is tolyltriazole.

14. A lubricating oil composition as in any one of the preceding claims, in which said composition comprises a major amount of a hydrocarbon lubricating oil and from 0.5–2.0 weight percent of said reaction product.

15. A method of preparing a diesel engine lubricating oil composition which comprises adding to a major portion of a hydrocarbon lubricating oil 0.1–5.0 weight percent of a reaction product prepared by reacting at a temperature range of 50° C.–200° C.:

(a) 0.5–2.5 moles of a dibasic acid anhydride;

(b) 0.5–1.5 moles of a polyoxyalkylene diamine of the formula $$NH_2-(R_1)_q-[O\overset{\overset{CH_2CH_3}{|}}{CH}CH_2]_a-[O\underset{\underset{CH_3}{|}}{CH}CH_2]_b-[OCH_2CH_2]_c-$$

$$-[OCH_2\underset{\underset{CH_3}{|}}{CH}]_d-[OCH_2\overset{\overset{CH_2CH_3}{|}}{CH}]_e-(R_2)_r-NH_2$$

where $R_1$ and $R_2$ are $C_1$–$C_{12}$ alkylene groups, q and r are integers having a value of 0 or 1, c has a value from 2–150, b+d has a value from 2–150, and a+e has a value from 0–12; and (c) 0.5–1.5 moles of a heterocyclic azole.

* * * * *